US007862841B1

(12) United States Patent
Boyd

(10) Patent No.: US 7,862,841 B1
(45) Date of Patent: Jan. 4, 2011

(54) MULTIPLE SERVING CONTAINER

(76) Inventor: Michael D Boyd, 1005 Terminal Way, Suite 110, Reno, NV (US) 89502

( * ) Notice: Subject to any disclaimer, the term of this patent is extended or adjusted under 35 U.S.C. 154(b) by 415 days.

(21) Appl. No.: 11/481,010

(22) Filed: Jul. 5, 2006

(51) Int. Cl.
*B65D 77/00* (2006.01)
*B65D 1/09* (2006.01)
*B65D 81/32* (2006.01)
*B65D 75/58* (2006.01)

(52) U.S. Cl. ..... 426/115; 426/120; 426/123; 426/122; 206/528; 206/217

(58) Field of Classification Search ..... 206/568, 206/219–222, 217, 532, 540, 528; 220/153.07; 426/122, 123, 115, 120; 383/904, 200, 207–209; 229/87.05; 222/541.1, 541.6, 541.9, 215; 215/250, 253, 254, 256
See application file for complete search history.

(56) References Cited

U.S. PATENT DOCUMENTS 1,489,806 A * 4/1924 Anderson ..... 426/77
1,639,759 A * 8/1927 Whelan ..... 383/202
2,079,328 A * 5/1937 McBean ..... 229/87.05
2,430,995 A * 11/1947 Roos ..... 222/107
3,263,863 A * 8/1966 Hoag ..... 222/107
3,601,252 A * 8/1971 Sager ..... 426/115
3,857,423 A * 12/1974 Ronca, Jr. ..... 141/5
4,290,526 A * 9/1981 Haiss ..... 229/87.05
5,046,627 A * 9/1991 Hansen ..... 215/40
5,121,856 A * 6/1992 Weiler et al. ..... 222/209
5,125,534 A * 6/1992 Rose et al. ..... 222/54
5,579,943 A * 12/1996 Johnson ..... 220/258.2
5,685,643 A * 11/1997 Stary ..... 383/24
5,984,141 A * 11/1999 Gibler ..... 222/80
6,116,441 A * 9/2000 Decelles et al. ..... 215/237
6,391,353 B1 * 5/2002 Marbler et al. ..... 426/115
6,708,738 B2 * 3/2004 Olsen ..... 141/114
7,219,796 B2 * 5/2007 Anderson ..... 206/222
2004/0069148 A1 * 4/2004 Fenaroli ..... 99/275

FOREIGN PATENT DOCUMENTS

EP 562592 A2 * 9/1993

* cited by examiner

*Primary Examiner*—Mickey Yu
*Assistant Examiner*—Melissa L Lalli
(74) *Attorney, Agent, or Firm*—Michael I Kroll

(57) ABSTRACT

A multiple serving container shaped to incorporate an opening dimensionally sized to fit within the opening of the typical plastic liquid containers used for bottling water, fruit juice and soda. The serving container fitting inside an opening into the liquid container allows transfer of contents without spillage.

8 Claims, 18 Drawing Sheets

MULTIPLE SERVING CONTAINER

BACKGROUND OF THE INVENTION

1. Field of the Invention

The present invention relates generally to containers and, more specifically, to a multiple serving container shaped to incorporate an opening dimensionally sized to fit within the opening of the typical plastic liquid containers used for bottling water, fruit juice, soda, etc.

As often occurs in industry, the cost of manufacture plays a significant role in cost of product, which includes tooling with most dispensing operation fully automated. The liquid dispensing operation uses its own production parameters including containers having a specified opening for filling. In a typical PET water bottle the opening is approximately 2 cm. While the shape of the container may vary by design, the opening will remain within a specified parameter, which will be considered typically 2 centimeters.

The multiple serving container of the present invention provides an opening with an outside diameter scaled to less than the typical opening whereby the contents of the distributing container are easily dispensed therefrom.

2. Description of the Prior Art

While the prior art containers may be suitable for the purposes for which they were designed, they would not be as suitable for the purposes of the present invention, as hereinafter described.

SUMMARY OF THE PRESENT INVENTION

A primary object of the present invention is to provide a multiple serving container for the typical plastic liquid container for dispensing a product therein.

Another object of the present invention is to provide a multiple serving container having an opening typically less than 2 centimeters in communication with a compartment having a dispensable product therein.

Yet another object of the present invention is to provide a multiple serving container with an opening having an outside diameter defined approximately 50 percent to 98 percent of the typical opening.

Still yet another object of the present invention is to provide a multiple serving container with an opening having an outside diameter of approximately one to two centimeters.

Another object of the present invention is to provide a multiple serving container having a burstable seal over the opening once the contents are placed therein.

Yet another object of the present invention is to provide a multiple serving container Still yet another object of the present invention is to provide a multiple serving container having a burstable seal over the opening once the contents are placed therein creating an environment that is hermetically sealed, tamper-free and fresh including vacuum packed.

Additional objects of the present invention will appear as the description proceeds.

The present invention overcomes the shortcomings of the prior art by providing a multiple serving container shaped to incorporate an opening dimensionally sized to fit within the opening of the typical plastic liquid containers used for bottling water, fruit juice and soda.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
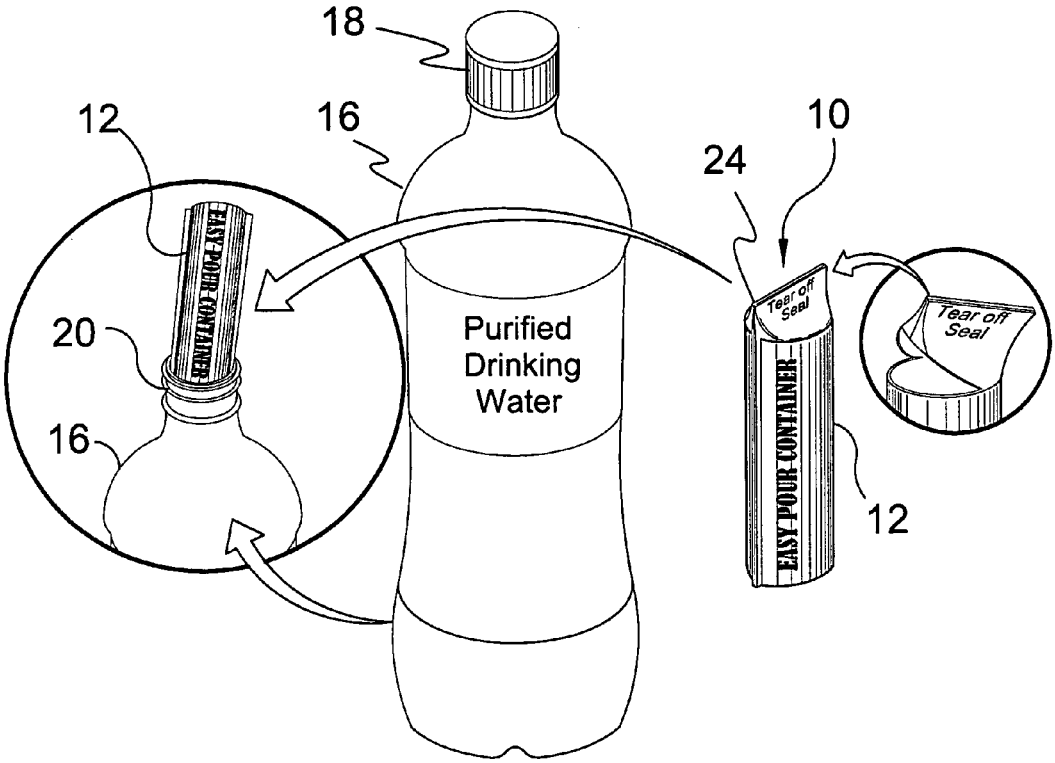
FIG. 1 is an illustrative view of the present invention.

Turning now descriptively to the drawings, in which similar reference characters denote similar elements throughout the several views, the figures illustrate the Multiple Use Container of the present invention. With regard to the reference numerals used, the following numbering is used throughout the various drawing figures.

10 Hermetically Sealed Multiple Use Container of the present invention

12 container

16 beverage container

18 cap of 16

20 mouth of 16

22 mouth of 12

24 protective seal
26 seam of 12
32 contents of 12
34 liquid in 16
36 indicia
100 additional Multiple Use Container of the present invention
102 container
104 cap of 102
106 mouth of 102
108 protective seal
110 pull tab of 108
112 contents of 102

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the present invention 10. The present invention 10 is a multiple serving container 12 to easily and conveniently pour a consumable content into the mouth 20 of a liquid container 16 having cap 18 without spilling the content. The container 10 would be packaged to provide any consumable item that would mix with water such as protein powders, energy drink powders, various herbal/botanical mixtures, medications and more. The container 10 has a planar and circular closed bottom and a circular mouth at its top. The circular mouth and the planar bottom have the same diameter. The container 10 has a cylindrical body with a pair of opposed, linear, longitudinally disposed seams extending outwardly from and linearly along the cylindrical body. The container 10 is provided with a hermetically sealed burstable seal 24 for freshness and security. The removable seal element 24 comprises a pair of members extending up from opposite sides of the circular mouth of the container 10 to a linear top edge where both the members come together and are flush. Each seam in the pair of seams of the cylindrical body terminates at the linear top edge of the seal element. The seal element 24 is tearable along an entire edge of the circular mouth of the container 10. Two pieces of plastic sheet material are hermetically sealed along the pair of seams of the cylindrical body and along the linear top edge of the seal element 24 to form the container 10. The container 10 is small enough to fit in a purse, pocket or to mail. The cylindrical body is provided with vertically extending indicia between the pair of seams of the cylindrical body of the container 10 to inform the user of the contents contained therein.

Figure 2:
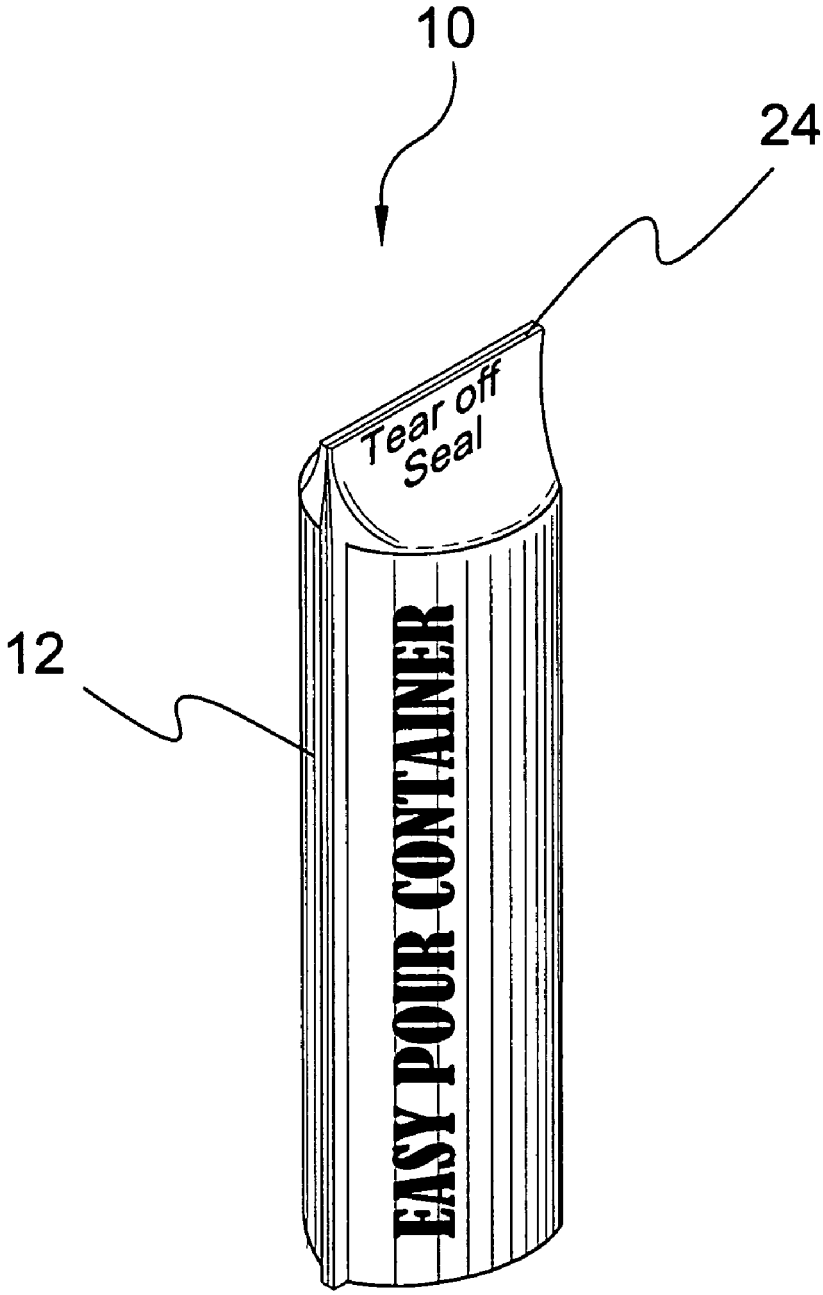
FIG. 2 is an external view of the container of the present invention.

Referring to FIG. 2, shown is an external view of the container of the present invention 10. The serving container 12 of the present invention 10 is easy and convenient for pouring a consumable content into the mouth of a container or water bottle without spilling the contents. It is designed so the width of the container 12 is smaller then the width of the water bottle mouth, allowing the container 12 to fit inside the mouth of the water bottle, allowing for easy pouring of the contents into the water bottle without spilling. Hermetically sealed burstable seal 24 is provided for freshness and security.

Figure 3:
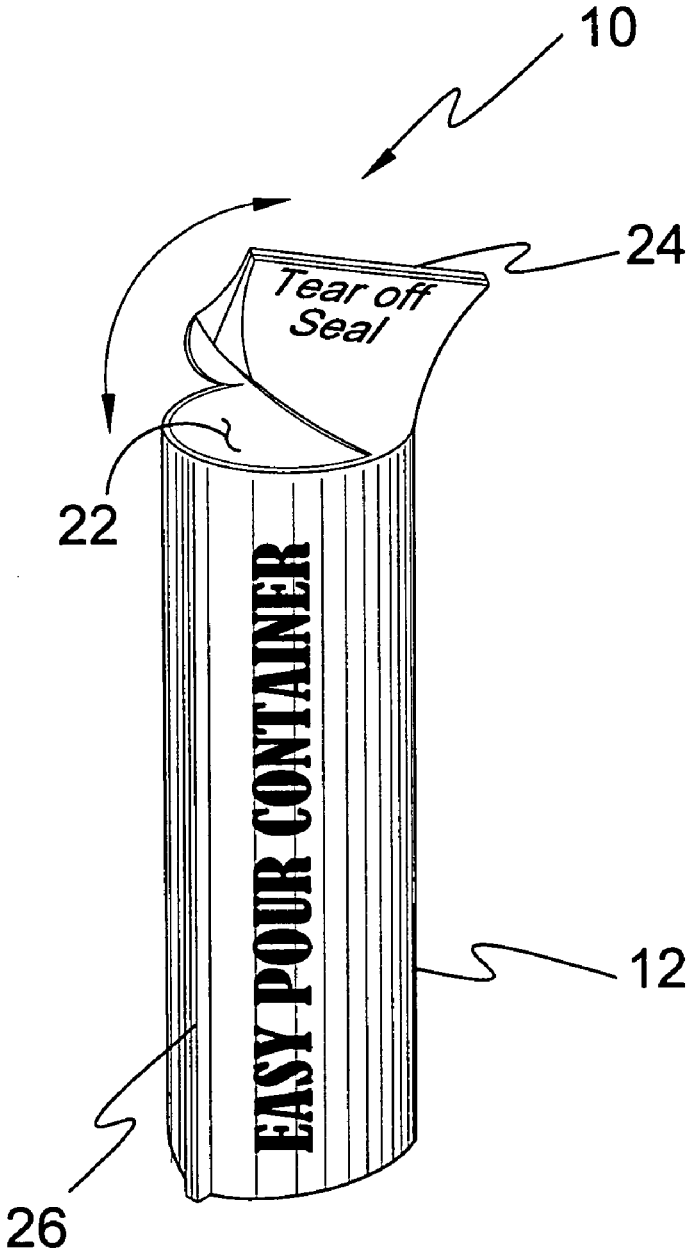
FIG. 3 is a perspective view of the container of the present invention.

Referring to FIG. 3, shown is a perspective view of the present invention 10. Shown is the serving container 12 of the present invention having a hermetically sealed burstable seal 24 for freshness and security. The container 12, which is of a soft plastic having seal 26 provides tear seal 24 that protects the contents within, keeping the product fresh and tamper free. The device is designed so the mouth 22 of the container 12 is smaller then the width of the water bottle mouth 20, allowing the container 12 to fit inside the mouth of the water bottle, for easy pouring of the contents into the water bottle without spilling.

Figure 4:
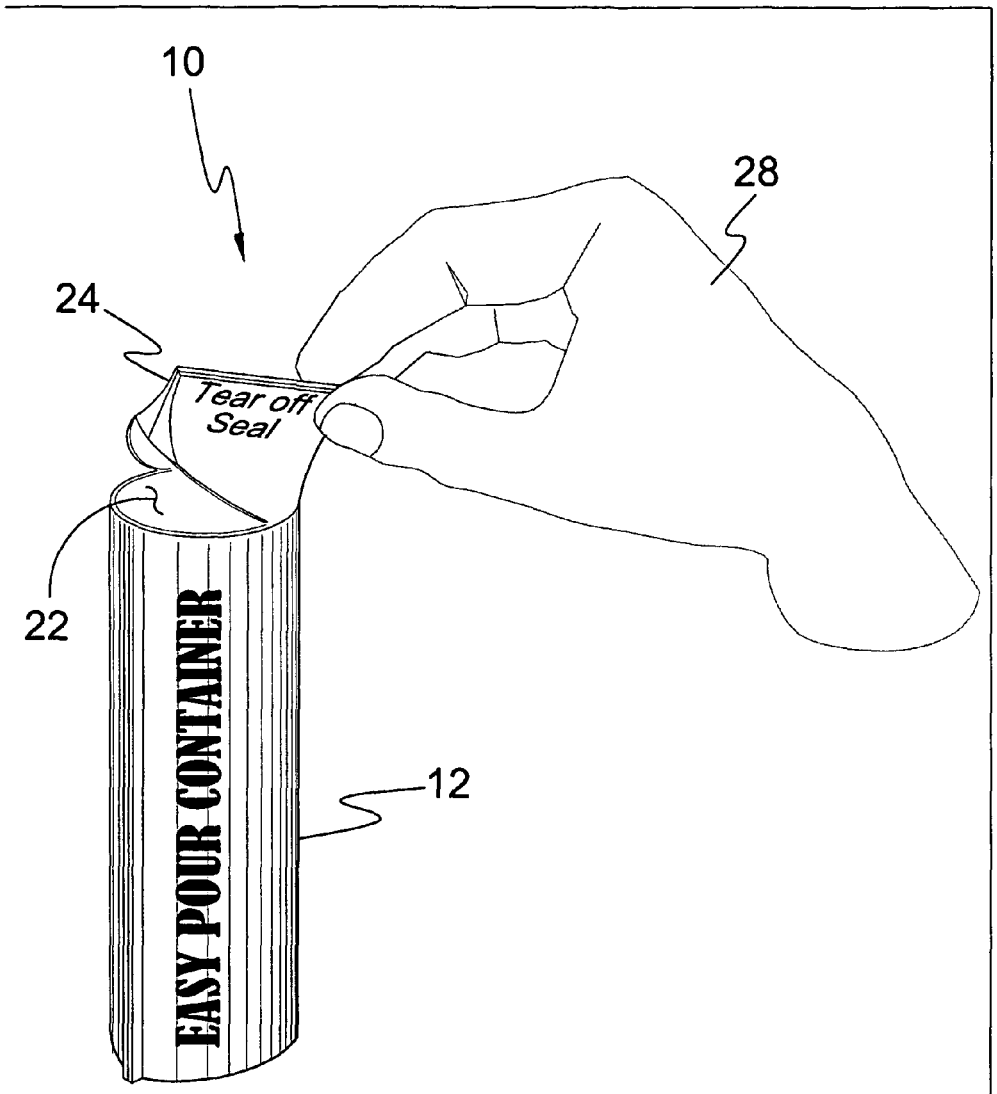
FIG. 4 is an illustrative view of the container of the present invention.

Referring to FIG. 4, shown is an illustrative view of the present invention 10. Shown is the serving container 12 of the present invention 10 having its hermetically sealed burstable seal 24 being removed from the container 12 by the user 28. The seal 24 protects the contents within, keeping the product fresh and tamper free. The device is designed so the width of the mouth 22 of the container 12 is smaller then the width of the water bottle mouth, allowing the container 12 to fit inside the mouth of the water bottle, for easy pouring of the contents into the water bottle without spilling.

Figure 5:
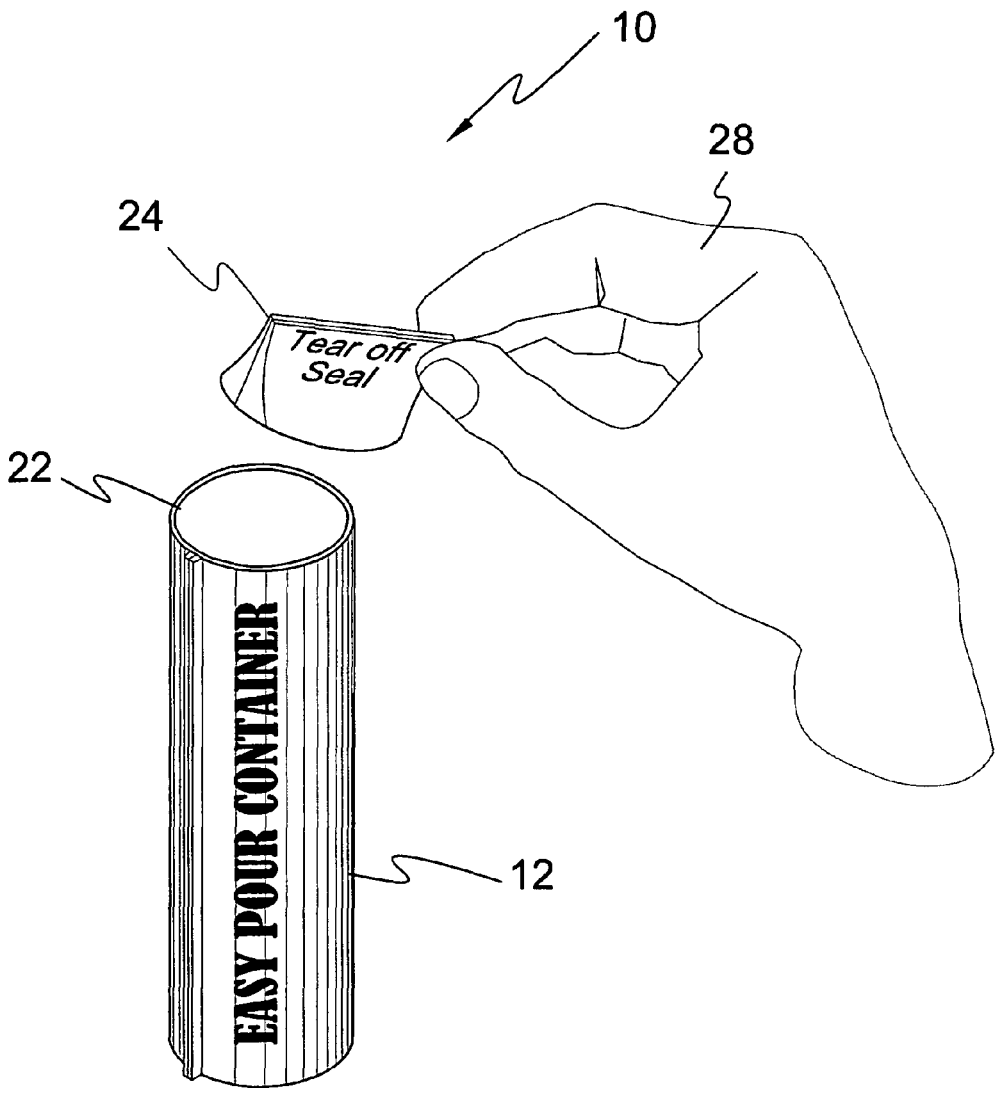
FIG. 5 is an illustrative view of the container of the present invention.

Referring to FIG. 5, shown is an illustrative view of the present invention 10. Shown is the serving container 12 of the present invention 10 having its hermetically sealed burstable seal 24 removed from the container 12 by the user 28. The seal 24 protects the contents within, keeping the product fresh and tamper free. The device is designed so the width of the mouth 22 of the container 12 is smaller then the width of the water bottle mouth, allowing the container 12 to fit inside the mouth of the water bottle, for easy pouring of the contents into the water bottle without spilling.

Figure 6:
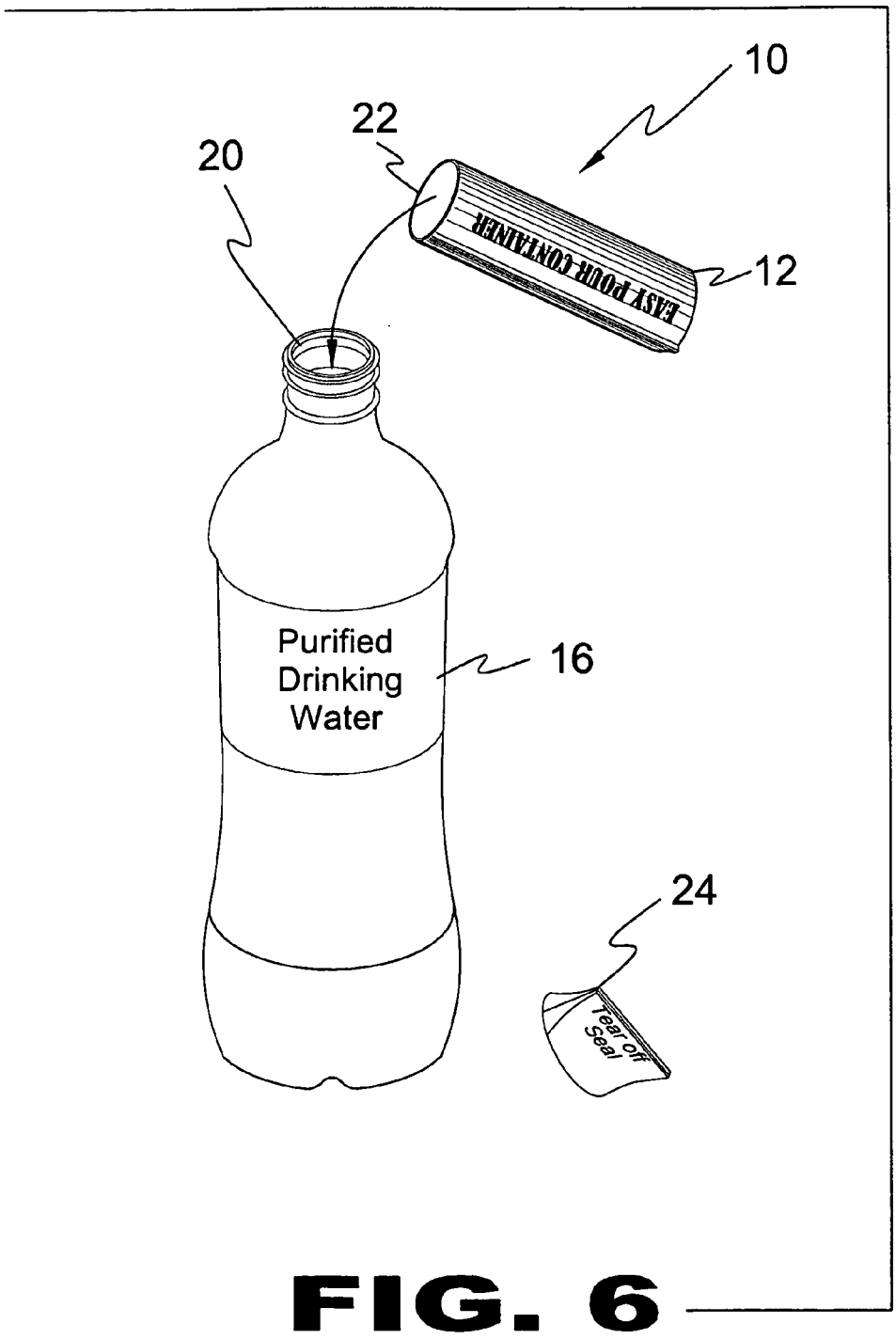
FIG. 6 is an illustrative view of the present invention.

Referring to FIG. 6, shown is an illustrative view of the present invention 10. Shown is the multiple serving container 12 to easily and conveniently pour a consumable content into the mouth 20 of a container or water bottle 16 without spilling the content. The cap 18 of the water bottle and the hermetically sealed burstable seal 24 of container 12 are removed. The mouth 22 of the container 12 is narrower than the mouth 20 of the water bottle 16. The container 12 would be packaged to provide any consumable item that would mix with water such as protein powders, energy drink powders, various herbal/botanical mixtures, medications and more.

Figure 7:
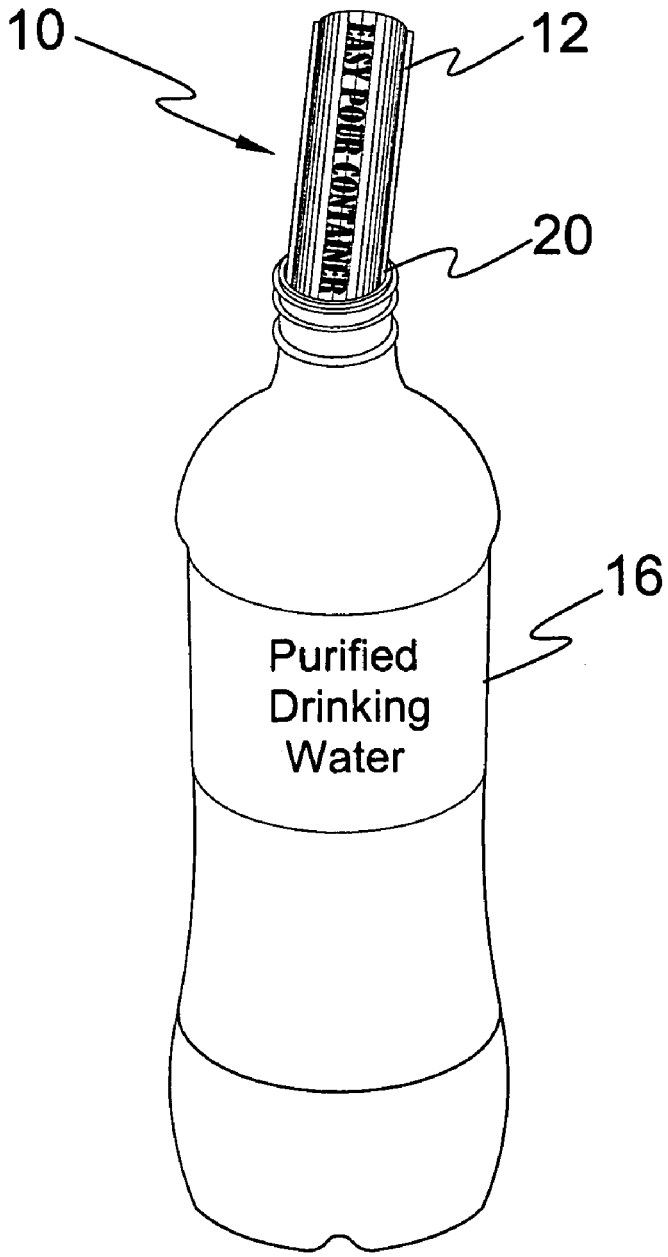
FIG. 7 is an illustrative view of the container of the present invention.

Referring to FIG. 7, shown is an illustrative view of the present invention 10. Shown is the serving container 12 of the present invention 10 having its hermetically sealed burstable seal 24 removed from the container and the container 12 inserted into the mouth 20 of a water bottle 16. The device is designed so the width of the container 12 is smaller then the width of the water bottle mouth 18, allowing the container 12 to fit inside the mouth 20 of the water bottle 16 for easy pouring of the contents into the water bottle 16 without spilling.

Figure 8:
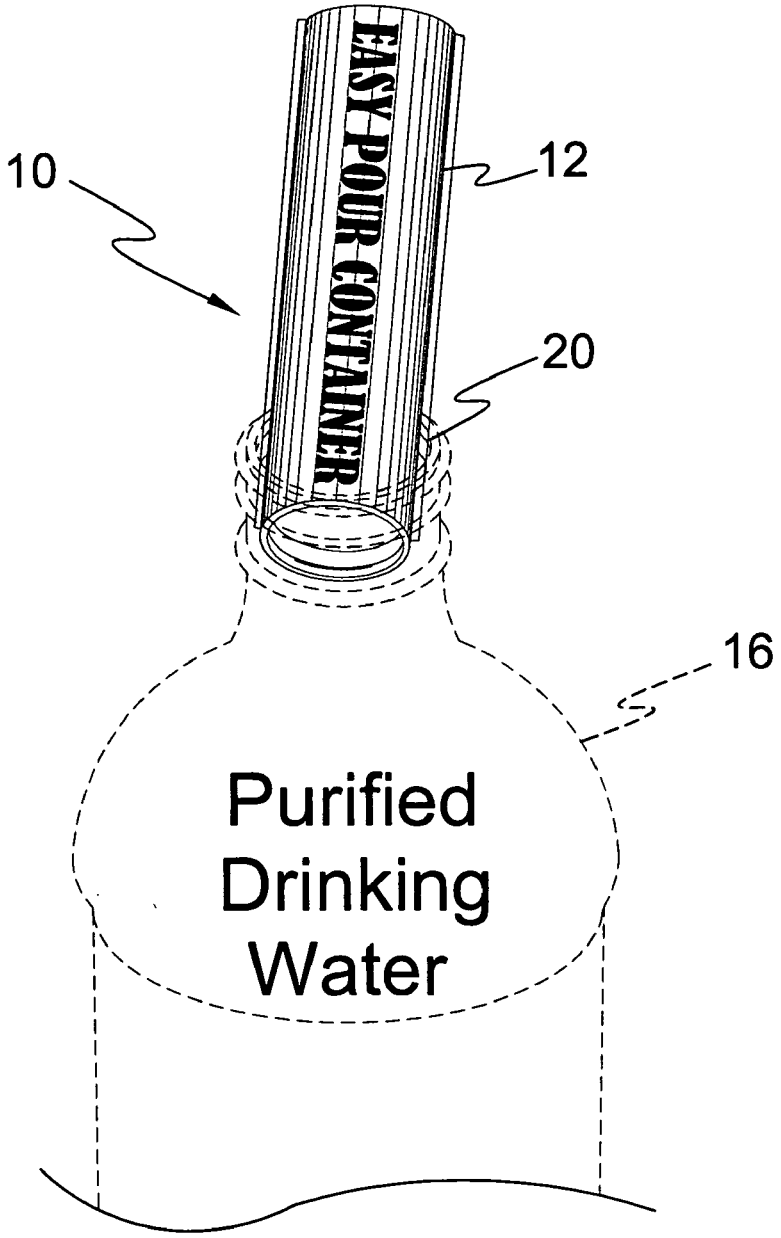
FIG. 8 is a detailed view of the container of the present invention.

Referring to FIG. 8, shown is a detailed view of the container of the present invention 10. Shown is the serving container 12 of the present invention 10 having its hermetically sealed burstable seal 24 lifted from the container and the container 12 inserted into the mouth 20 of a water bottle 16. The device is designed so the width of the container 12 is smaller then the width of the water bottle mouth 20, allowing the container 12 to fit inside the mouth 20 of the water bottle 16 for easy pouring of the contents into the water bottle 16 without spilling.

Figure 9:
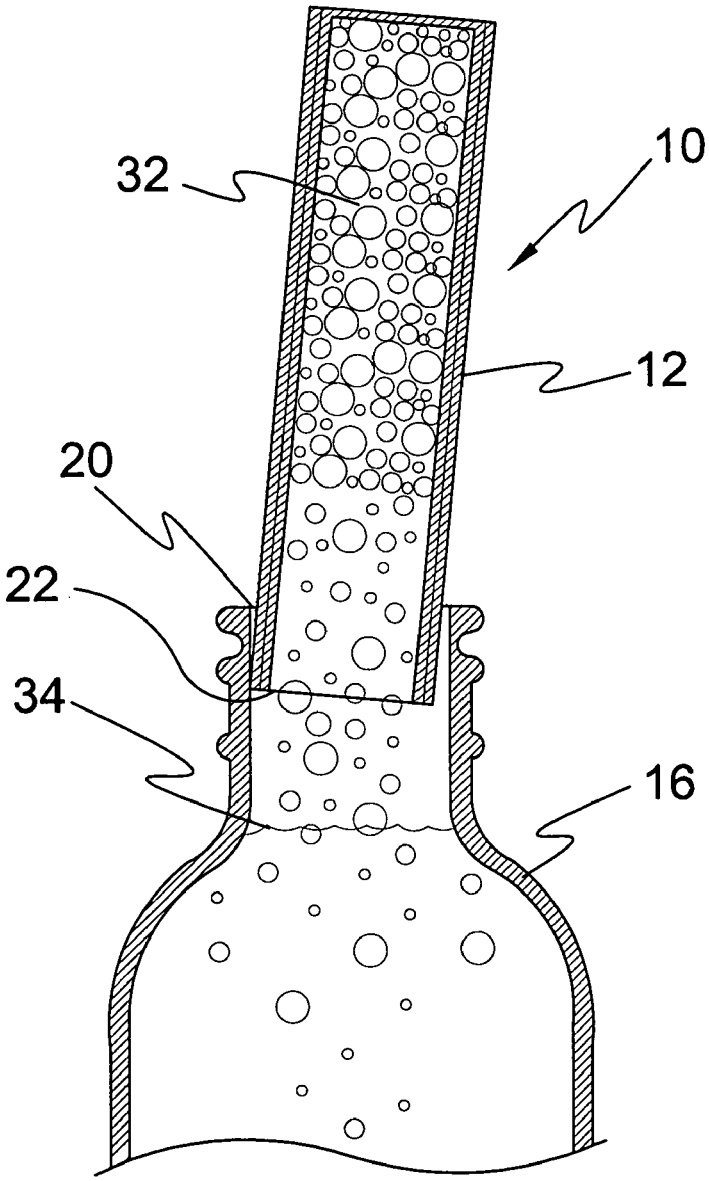
FIG. 9 is a sectional view of the present invention.

Referring to FIG. 9, shown is a sectional view of the present invention 10. Shown is the multiple serving container 12 conveniently pouring a consumable content 32 into the mouth 20 of a container or water bottle 16 without spilling the content 32. The width of the container 12 is smaller then the width of the water bottle mouth 20 allowing the container 12 to be inserted within the mouth 20 of the water bottle 16 to empty its contents 32. The container 12 would be packaged to provide any consumable item that would mix with water 34 such as protein powders, energy drink powders, various herbal/botanical mixtures, medications and more.

Figure 10:
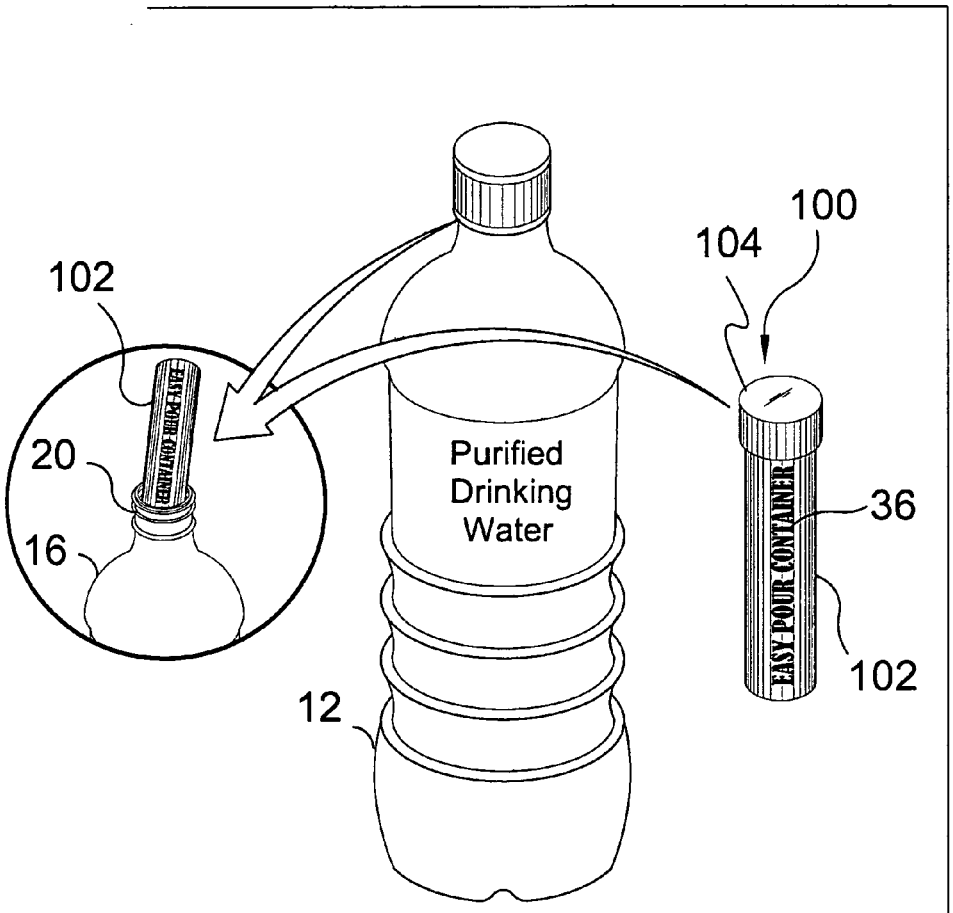
FIG. 10 is an illustrative view of an additional container of the present invention.

Referring to FIG. 10, shown is an illustrative view of an alternate embodiment of the present invention 100. The present invention 100 is a multiple serving container 102 to easily and conveniently pour a consumable content into the mouth 18 of a liquid container 16 without spilling the content. The container 100 would be packaged to provide any consumable item that would mix with water 20 such as protein powders, energy drink powders, various herbal/botanical mixtures, medications and more. Each container 100 is provided with a removable cap 104 and an aluminum removable pull tab for freshness and security. Small enough to fit in a purse, pocket or to mail. Indicia 36 on the container 102 is provided to inform the user of the contents contained therein.

Figure 11:
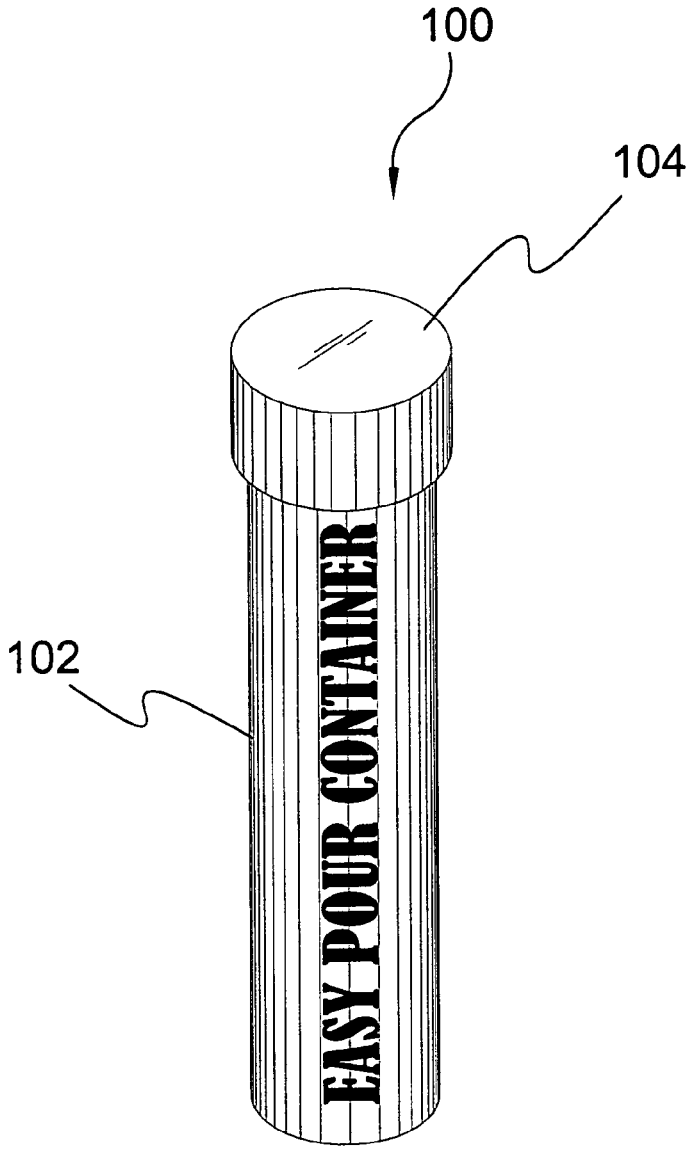
FIG. 11 is an external view of the additional container of the present invention.

Referring to FIG. 11, shown is an external view of the container of the present invention 100. The serving container 102 of the present invention 100 is easy and convenient for pouring a consumable content into the mouth of a container or water bottle without spilling the content. It is designed so the width of the container 102 is smaller then the width of the water bottle mouth, allowing the container 102 to fit inside the mouth of the water bottle, allowing for easy pouring of the contents into the water bottle without spilling. A removable cap 14 is also provided.

Figure 12:
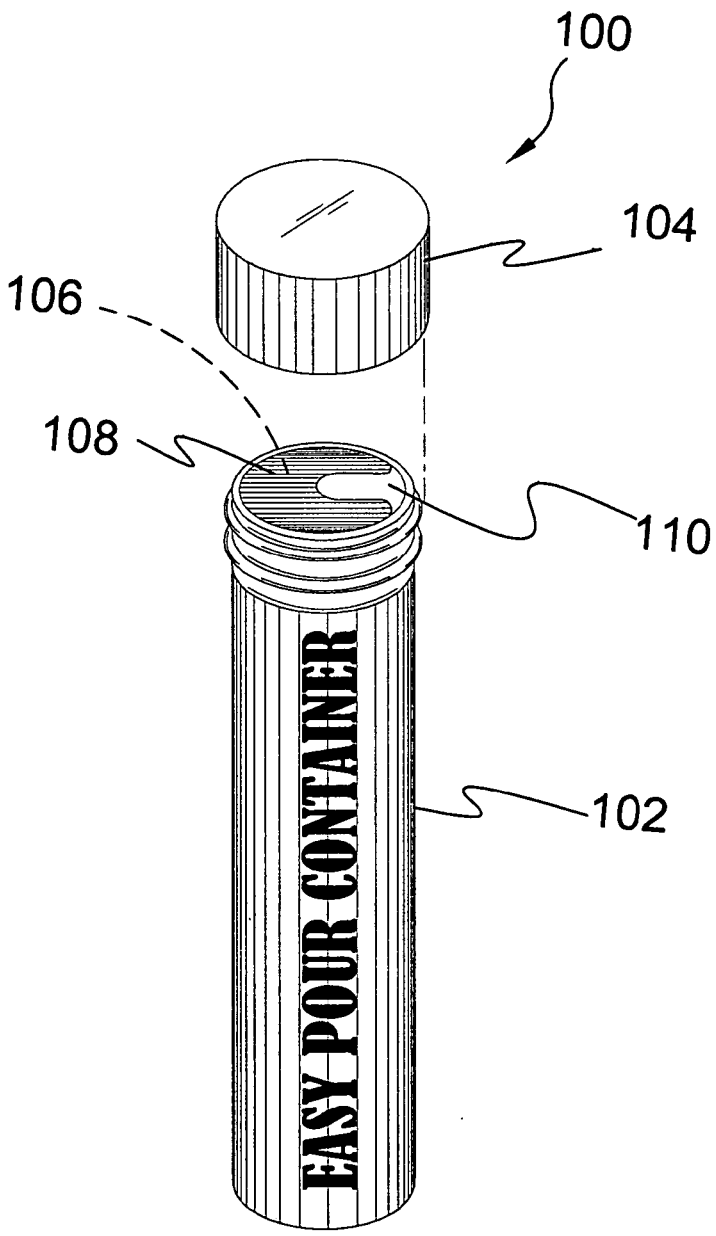
FIG. 12 is a perspective view of the additional container of the present invention.

Referring to FIG. 12, shown is a perspective view of the present invention 100. Shown is the serving container 102 of the present invention having its cap 104 removed and the aluminum foil seal 24 and its pull tab 26 visible. The seal 24 protects the contents within, keeping the product fresh and tamper free. The device is designed so the mouth 22 of the container 102 is smaller then the width of the water bottle mouth, allowing the container 102 to fit inside the mouth of the water bottle, for easy pouring of the contents into the water bottle without spilling.

Figure 13:
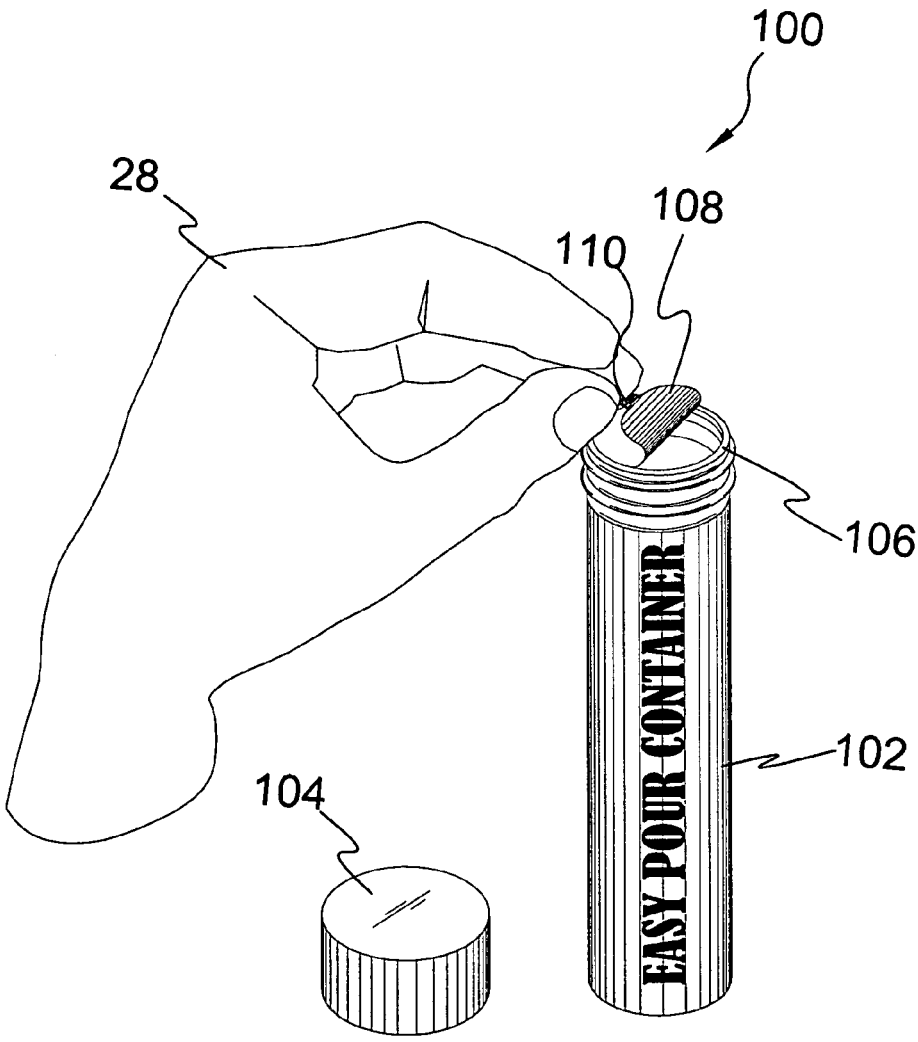
FIG. 13 is an illustrative view of the additional container of the present invention.

Referring to FIG. 13, shown is an illustrative view of the present invention 100. Shown is the serving container 102 of the present invention 100 having its cap 104 removed and the aluminum foil seal 24 being lifted from the container 102 by the user 28 with the pull-tab 26. The seal 24 protects the contents within, keeping the product fresh and tamper free. The device is designed so the width of the mouth 22 of the container 102 is smaller then the width of the water bottle mouth, allowing the container 102 to fit inside the mouth of the water bottle, for easy pouring of the contents into the water bottle without spilling.

Figure 14:
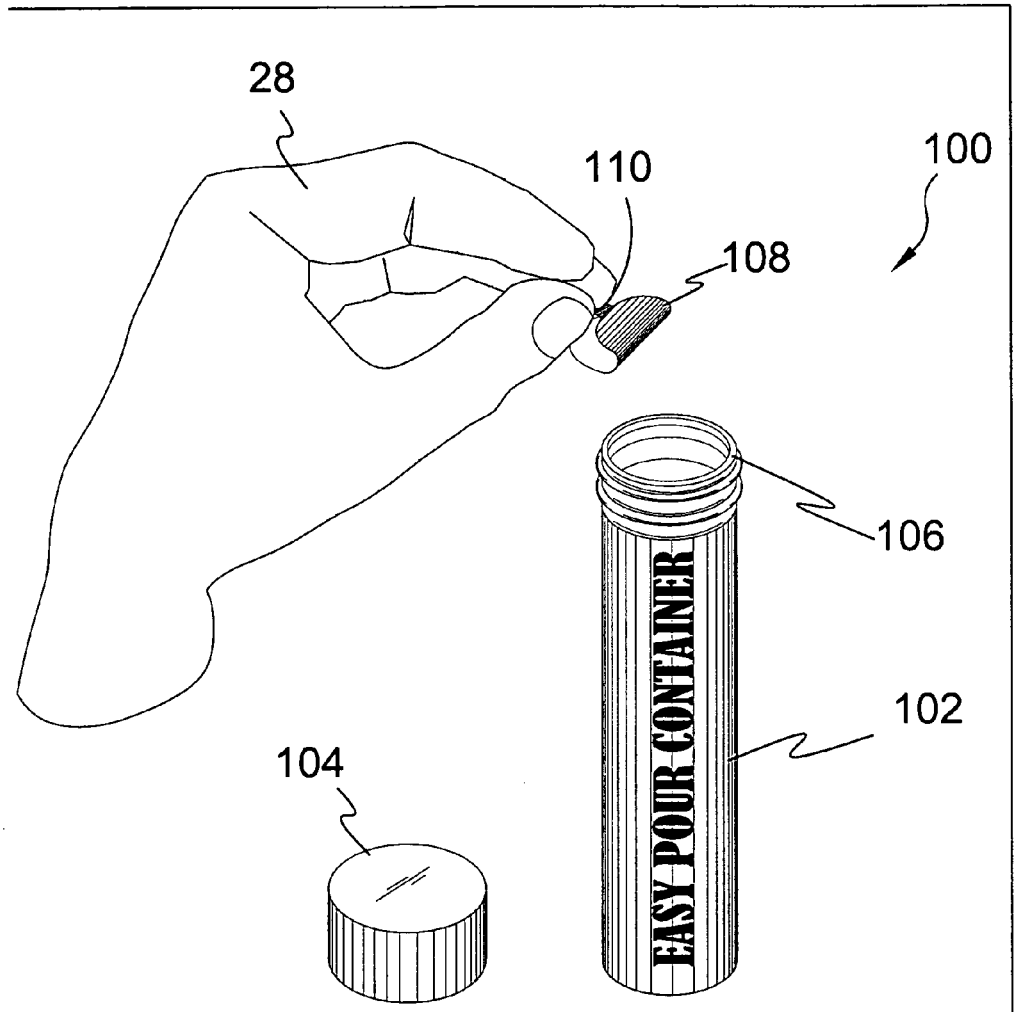
FIG. 14 is an illustrative view of the additional container of the present invention.

Referring to FIG. 14, shown is an illustrative view of the present invention 100. Shown is the serving container 102 of the present invention 100 having its cap 104 removed and the aluminum foil seal 24 being lifted from the container 102 by the user 28 with the pull-tab 26. The seal 24 protects the contents within, keeping the product fresh and tamper free. The device is designed so the width of the mouth 22 of the container 102 is smaller then the width of the water bottle mouth, allowing the container 102 to fit inside the mouth of the water bottle, for easy pouring of the contents into the water bottle without spilling.

Figure 15:
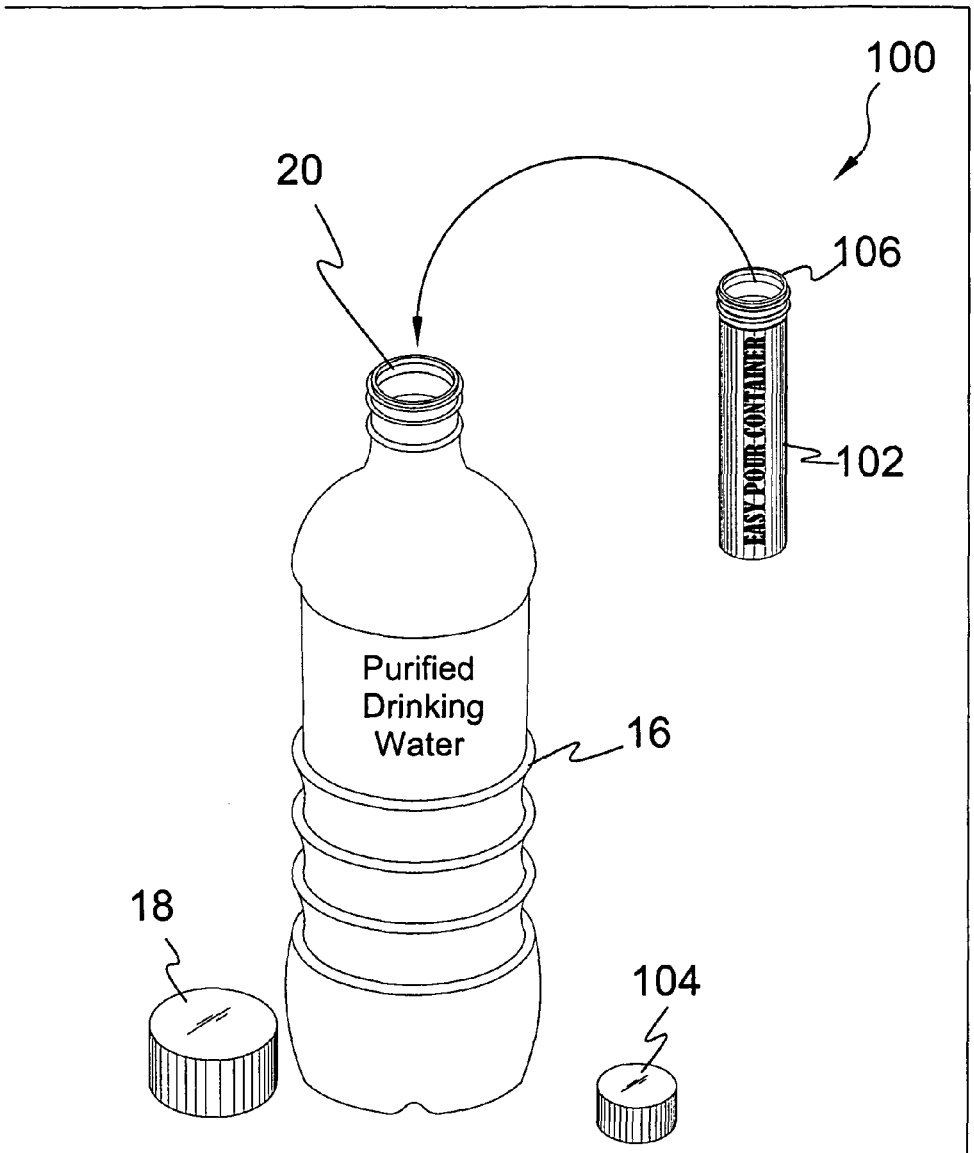
FIG. 15 is an illustrative view of the additional container of the present invention.

Referring to FIG. 15, shown is an illustrative view of the present invention 100. Shown is the multiple serving container 102 to easily and conveniently pour a consumable content into the mouth 18 of a container or water bottle 16 without spilling the content. The cap 30 of the water bottle and the cap 104 of the container 102 are removed. The mouth 22 of the container 102 is narrower than the mouth 18 of the water bottle 16. The container 102 would be packaged to provide any consumable item that would mix with water such as protein powders, energy drink powders, various herbal/botanical mixtures, medications and more. Each container 12 is provided with an aluminum removable pull tab for freshness and security.

Figure 16:
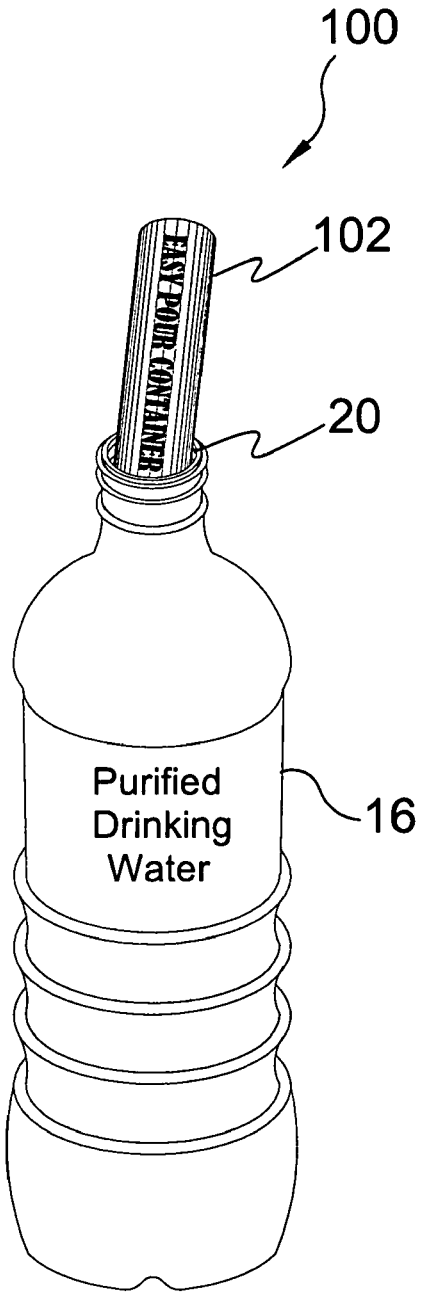
FIG. 16 is an illustrative view of the additional container of the present invention.

Referring to FIG. 16, shown is an illustrative view of the present invention 100. Shown is the serving container 102 of the present invention 100 having its cap removed, aluminum foil seal lifted from the container and the container 102 inserted into the mouth 18 of a water bottle 16. The device is designed so the width of the container 102 is smaller then the width of the water bottle mouth 18, allowing the container 102 to fit inside the mouth 18 of the water bottle 16 for easy pouring of the contents into the water bottle 16 without spilling.

Figure 17:
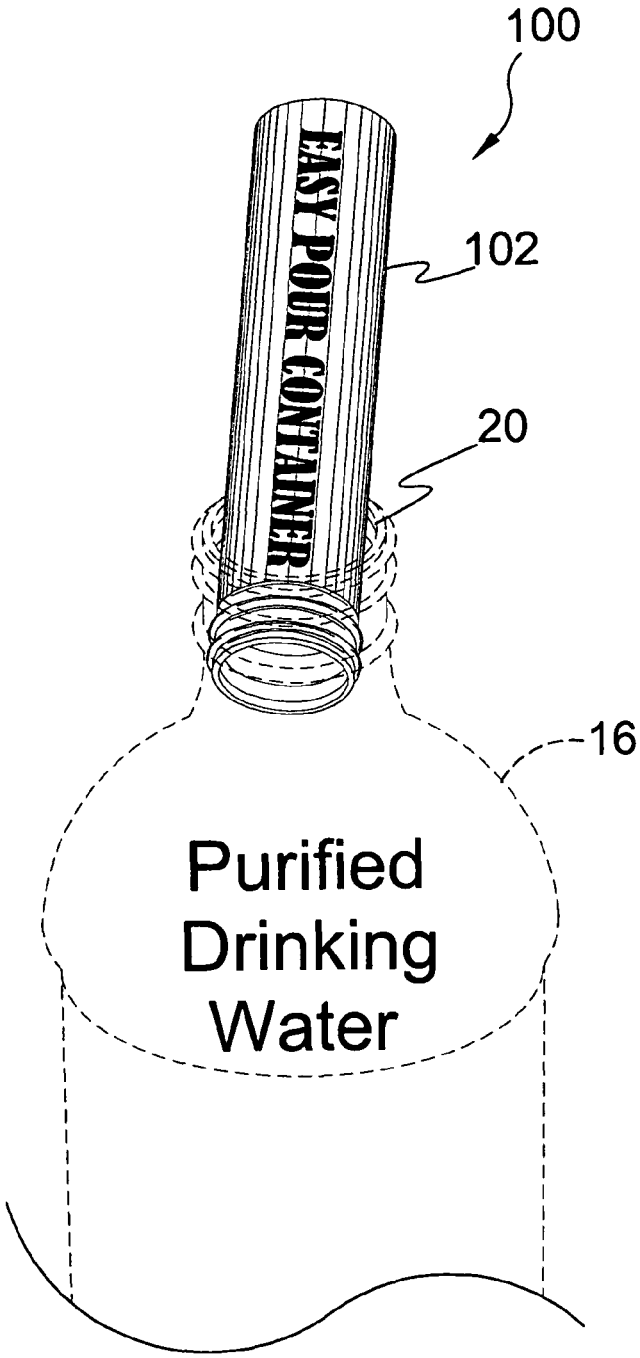
FIG. 17 is a detailed view of the additional container of the present invention.

Referring to FIG. 17, shown is a detailed view of the container of the present invention 100. Shown is the serving container 102 of the present invention 100 having its cap removed, aluminum foil seal lifted from the container and the container 102 inserted into the mouth 18 of a water bottle 16. The device is designed so the width of the container 102 is smaller then the width of the water bottle mouth 18, allowing the container 102 to fit inside the mouth 18 of the water bottle 16 for easy pouring of the contents into the water bottle 16 without spilling.

Figure 18:
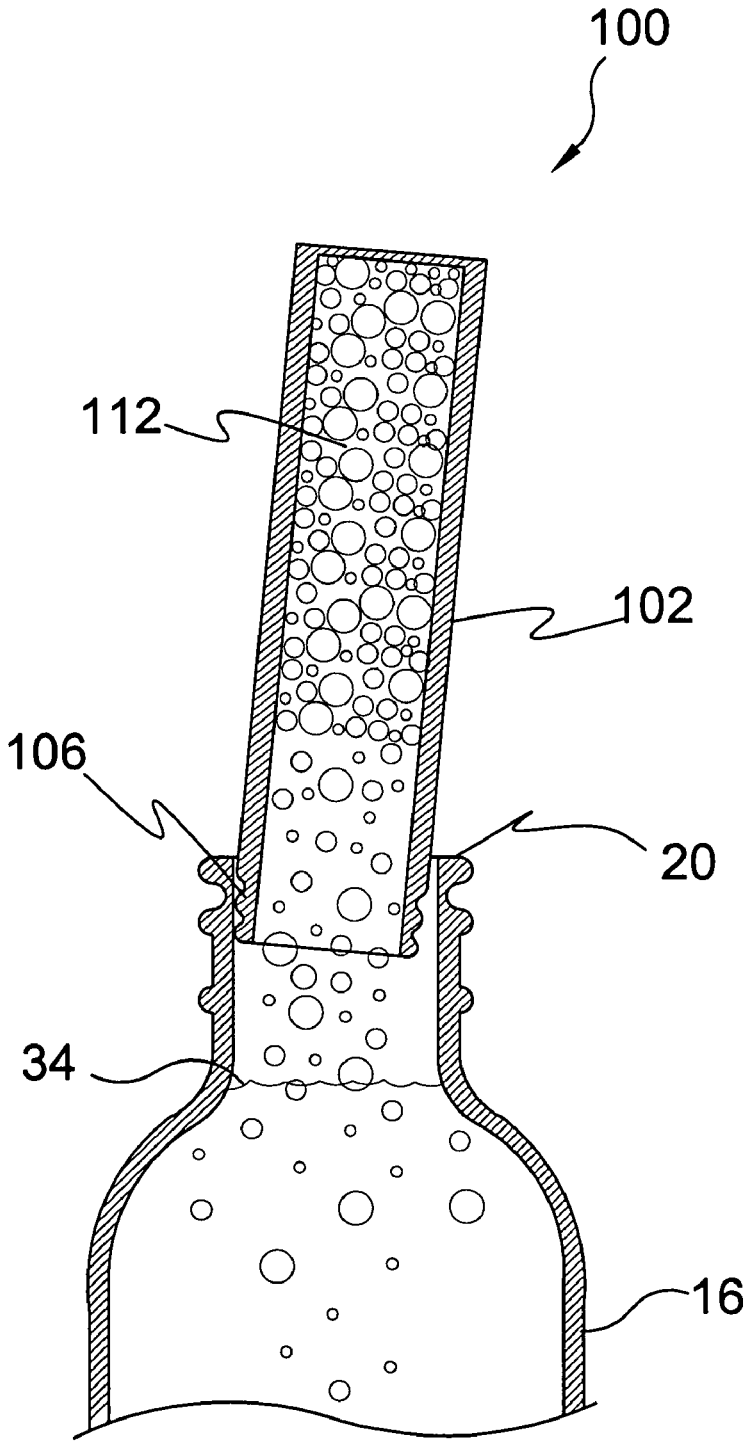
FIG. 18 is a sectional view of the additional container of the present invention.

Referring to FIG. 18, shown is a sectional view of the present invention 100. Shown is the multiple serving container 102 conveniently pouring a consumable content 32 into the mouth 18 of a container or water bottle 16 without spilling the content 32. The width of the container 102 is smaller then the width of the water bottle mouth 18 allowing the container 18 to be inserted within the mouth 18 of the water bottle 16 to empty its contents 32. The container 102 would be packaged to provide any consumable item that would mix with water 34 such as protein powders, energy drink powders, various herbal/botanical mixtures, medications and more.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. A multiple use container comprising:

a) a container having a planar and circular closed bottom and circular mouth at a top thereof, said container has a cylindrical body with a pair of opposed, linear, longitudinally disposed seams extending outwardly from said cylindrical body, said seams extending linearly along said cylindrical body, wherein the circular mouth and said planar bottom have the same diameter;

b) a removable seal element disposed on said circular mouth;

c) a protein powder contained within said container for distribution into a beverage container having an opening large enough for said container circular mouth to fit inside so that the protein powder of said container can be easily transferred into said beverage container;

d) said seal element comprising a pair of members extending up from opposite sides of said circular mouth to linear top edge where both said members come together and are flush, said pair of seams of said cylindrical body terminating at said linear top edge of the seal element, said seal element tearable along an entire edge of said circular mouth; and e) said container being formed from two pieces of plastic sheet material hermetically sealed along said pair of seams of said cylindrical body and along said linear top edge of said seal element, said cylindrical body having vertically extending indicia between said pair of seams of said cylindrical body.

2. The multiple use container as recited in claim 1, wherein said container is transparent.

3. The multiple use container as recited in claim 1, wherein said container is translucent.

4. The multiple use container as recited in claim 3, wherein said container is a solid color.

5. The multiple use container as recited in claim 3, wherein said container has a multi-colored design.

6. The multiple use container as recited in claim 4, wherein said container is disposable.

7. The multiple use container as recited in claim 6, wherein said container is reusable.

8. A container in combination with a beverage container, the combination comprising:

a) a first container whose contents consist of a protein powder;

b) a beverage container containing water;

c) said first container having a round planar bottom and a round mouth at a top thereof, said first container having a cylindrical body with a pair of opposed, linear, longitudinally disposed seams extending outwardly from said cylindrical body, said seams extending linearly along said cylindrical body, wherein the round mouth and said planar bottom have the same diameter;

d) a removable seal element disposed on said round mouth;

e) said contents of said first container for distribution into said beverage container, said beverage container having an opening large enough for said first container round mouth to fit inside so that the contents of said first container can be easily transferred into said beverage container;

f) said seal element comprising a pair of members extending up from opposite sides of said round mouth to linear top edge where both said members come together and are flush, said pair of seams of said cylindrical body terminating at said linear top edge of the seal element, said seal element tearable along an entire edge of said round mouth; and g) said first container being formed from two pieces of plastic sheet material hermetically sealed along said pair of seams of said cylindrical body and along said linear top edge of said seal, said cylindrical body having vertically extending indicia between said pair of seams of said cylindrical body.

* * * * *